US007904982B2

(12) United States Patent
Park et al.

(10) Patent No.: US 7,904,982 B2
(45) Date of Patent: Mar. 15, 2011

(54) WASHING MACHINE HAVING STEAM GENERATOR AND METHOD FOR CONTROLLING THE SAME

(75) Inventors: Jee Hun Park, Suwon-Si (KR); Hyung Gyoon Kim, Suwon-Si (KR); Sang Yeon Pyo, Suwon-Si (KR); Jae Ryong Park, Hwasung-Si (KR); Sung Hoon Kim, Suwon-Si (KR); Eun Suk Bang, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1108 days.

(21) Appl. No.: 11/476,068

(22) Filed: Jun. 28, 2006

(65) Prior Publication Data

US 2007/0169279 A1 Jul. 26, 2007

(30) Foreign Application Priority Data

Jan. 26, 2006 (KR) ..... 10-2006-0008523

(51) Int. Cl.
*D06F 35/00* (2006.01)

(52) U.S. Cl. ..... 8/158; 68/12.02; 68/12.21

(58) Field of Classification Search ..... 8/158; 68/12.02, 68/12.21
See application file for complete search history.

(56) References Cited

U.S. PATENT DOCUMENTS

| | | | | |
|---|---|---|---|---|
| 3,952,181 | A * | 4/1976 | Reed | 392/397 |
| 7,614,106 | B2 * | 11/2009 | Oh et al. | 8/158 |
| 2004/0187527 | A1 * | 9/2004 | Kim et al. | 68/5 C |

FOREIGN PATENT DOCUMENTS

| | | | |
|---|---|---|---|
| CN | 1122620 | A | 5/1996 |
| DE | 30 22 823 | A1 | 1/1982 |
| EP | 1 275 767 | | 1/2003 |
| EP | 1 464 751 | | 10/2004 |
| EP | 1 507 028 | | 2/2005 |
| JP | 4-158896 | | 6/1992 |
| KR | 10-0510680 | | 8/2005 |

OTHER PUBLICATIONS

Japanese Search Report for corresponding Japanese Application 2006-200735.

Decision on Grant for corresponding Japanese Application 2006-200735.

Extended European Search Report for corresponding European Application 06013124.0-1256; mailed Apr. 15, 2010.

Chinese Office Action issued Feb. 27, 2009 in corresponding Chinese Patent Application 200610105512.X.

* cited by examiner

*Primary Examiner* — Michael Barr
*Assistant Examiner* — Jason Heckert
(74) *Attorney, Agent, or Firm* — Staas & Halsey LLP

(57) ABSTRACT

A washing machine having a steam generator, which prevents the accumulation of scale in the steam generator due to the long-term use thereof, and a method for controlling the same. The washing machine includes a water supply valve for supplying water to the inside of the steam generator therethrough so as to cool the steam generator when the operating time of the steam generator exceeds a predetermined time, and a controller for controlling the operation of a heater for heating the water supplied through the water supply valve.

7 Claims, 7 Drawing Sheets

WASHING MACHINE HAVING STEAM GENERATOR AND METHOD FOR CONTROLLING THE SAME

CROSS-REFERENCE TO RELATED APPLICATIONS

This application claims the benefit of Korean Patent Application No. 10-2006-0008523, filed Jan. 26, 2006, in the Korean Intellectual Property Office, the disclosure of which is incorporated herein by reference.

BACKGROUND OF THE INVENTION

1. Field of the Invention

The present invention relates to a washing machine having a steam generator, which prevents the accumulation of scale in the steam generator due to the long-term use thereof, and a method for controlling the same.

2. Description of the Related Art

Korean Patent Laid-open Publication No. 2004-0085507 (dated Oct. 8, 2004) discloses a conventional washing machine, in which steam is supplied to the inside of a tub so as to increase washing capacity.

A steam generator of the washing machine disclosed in the above Patent, includes a pressure container having an inlet, into which washing water is supplied, and an outlet, from which steam is discharged, a heater installed in the pressure container for heating the washing water supplied to the pressure container, an inlet valve for controlling the supply of the washing water into the pressure container, and an outlet valve for controlling the discharge of the steam from the pressure container.

The steam generator further includes a water level sensor for sensing the amount of the washing water supplied to the pressure container, a temperature sensor for controlling the operation of the heater according to the temperature in the pressure container, a pressure sensor for sensing the pressure in the pressure container, and a thermostat for cutting the power supplied to the heater off when the temperature in the pressure container is excessively elevated.

Since such a steam generator employs a method in which a designated amount of water contained in the pressure container is heated by the heater so as to generate steam, scale caused by calcium and magnesium components contained in the water is easily accumulated on the internal surface of the pressure container or the external surface of the heater. Accordingly, the steam generator is required to be frequently cleaned.

SUMMARY OF THE INVENTION

Accordingly, it is an aspect of the present invention to provide a washing machine having a steam generator for generating steam of a high temperature, which prevents the accumulation of scale in the steam generator, and a method for controlling the same.

Additional aspects and/or advantages of the invention will be set forth in part in the description which follows and, in part, will be apparent from the description, or may be learned by practice of the invention.

The foregoing and/or other aspects of the present invention are achieved by providing a washing machine having a steam generatorincluding a water supply valve for supplying water to the inside of the steam generator therethrough, and a heater for heating the water supplied through the water supply valve, the washing machine including a controller to control operations of the water supply valve and the heater, to thereby cool the steam generator when an operating time of the steam generator exceeds a predetermined time.

The controller includes a counter to measure the operating time of the steam generator.

The counter measures the operating time of the heater, cumulatively.

The controller turns the heater off, to thereby cool the steam generator.

According to an aspect of the present invention, the controller simultaneously turns the heater off, and opens the water supply valve to supply the water, to thereby cool the steam generator.

According to an aspect of the present invention, the water supply valve supplies cold water.

The washing machine further includes a temperature sensor for sensing the temperature of the water heated by the heater, wherein the controller controls a cooling operation of the steam generator based on the temperature of the water sensed by the temperature sensor.

The temperature sensor is installed on a body of the steam generator.

The controller compares the temperature of the water sensed by the temperature sensor to a reference temperature, and performs the cooling operation at least once according to the comparison result.

The reference temperature is more than a predetermined temperature set by a user for performing a washing operation.

It is another aspect of the present invention to provide a method for controlling a washing machine having a steam generatorincluding a water supply valve for supplying water to the inside of the steam generator therethrough and a heater for heating the water supplied through the water supply valve, the method including measuring an operating time of the steam generator, determining whether the measured operating time of the steam generator exceeds a predetermined time, and controlling the water supply valve and the heater so as to cool the steam generator, when it is determined that the measured operating time of the steam generator exceeds the predetermined time.

The operating time of the steam generator is a cumulative operating time of the heater.

The cooling operation of the steam generator is performed by turning the heater off.

The cooling operation of the steam generator is performed by simultaneously turning the heater off and opening the water supply valve to supply the water.

The controlling of the water supply valve and the heater includes sensing the temperature of the water, heated by the heater, using a temperature sensor; comparing the temperature of the water sensed by the temperature sensor to a reference temperature; and controlling the cooling operation of the steam generator according to the comparison result.

The cooling operation of the steam generator may be repeated until the temperature of the water sensed by the temperature sensor is lowered less than the reference temperature.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
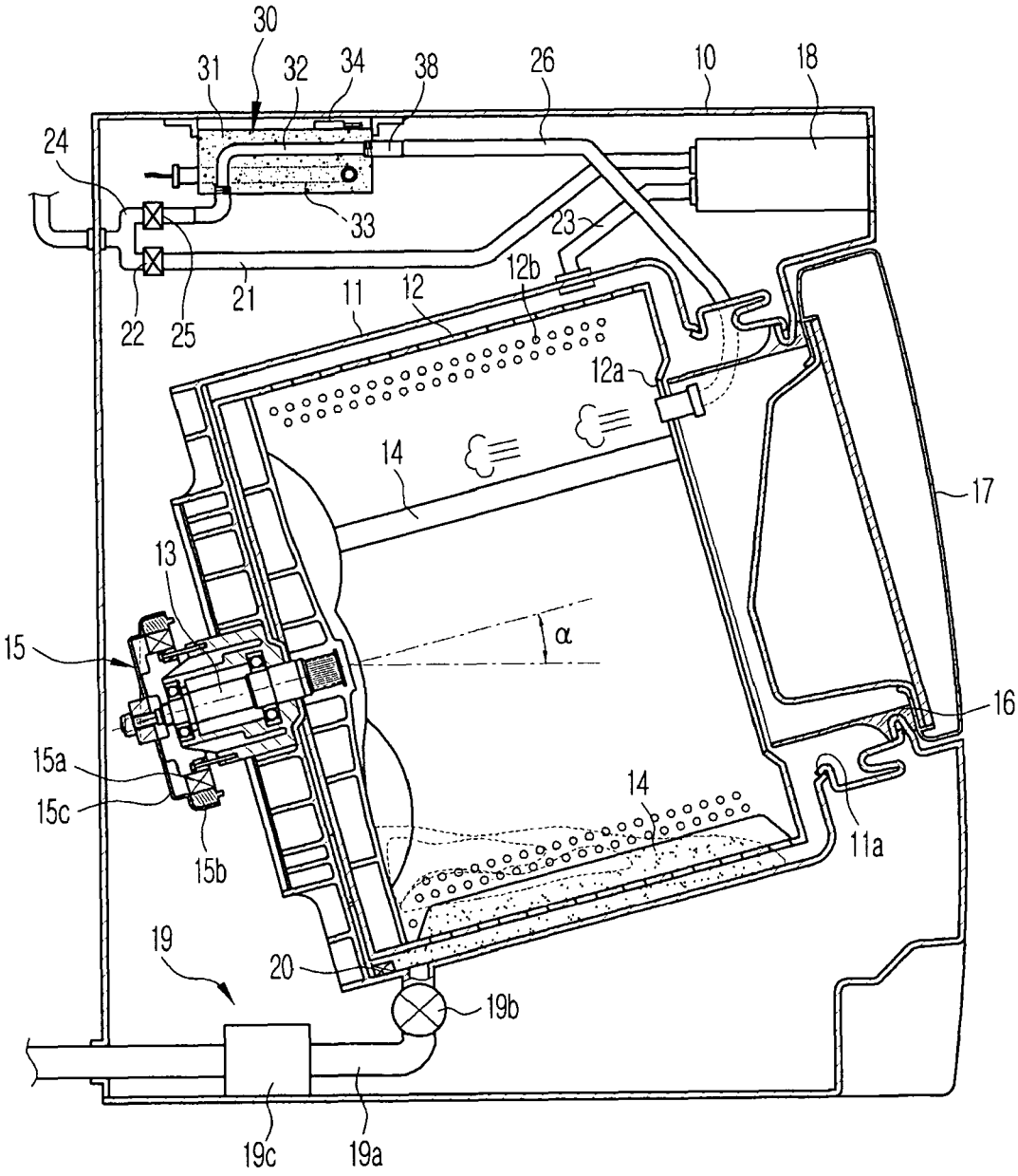
FIG. 1 is a sectional view of a washing machine in accordance with an aspect of the present invention.

Reference will now be made in detail to the embodiments of the present invention, an example of which is illustrated in the accompanying drawings, wherein like reference numerals refer to like elements throughout. The embodiments are described below to explain the present invention by referring to the figures.

As shown in FIG. 1, a washing machine in accordance with an embodiment of the present invention comprises a cylindrical tub 11 installed in a main body 10 for containing washing water, and a rotary drum 12 rotatably installed in the tub 11.

The tub 11 in the main body 10 is inclined against the installation plane of the washing machine at a designated angle a so that the front surface of the tub 11 provided with an inlet 11 a formed therethrough is higher than the rear surface of the tub 11. The rotary drum 12 in the tub 11 is inclined in the same manner as the tub 11. Since a rotary shaft 13 connected to the central portion of the rear surface of the rotary drum 12 is rotatably supported by the central portion of the rear surface of the tub 11, the rotary drum 12 is rotatable. A plurality of through holes 12*b* for passing the washing water are formed thorough the cylindrical surface of the rotary drum 12, and a plurality of lifters 14 for lifting and dropping laundry are installed on the inner surface of the rotary drum 12.

A washing motor 15 for rotating the rotary drum 12 is installed on the rear surface of the tub 11. The washing motor 15 comprises a stator 15*a* fixed to the rear surface of the tub 11, a rotor 15*b* rotatably disposed around the circumference of the stator 15*a*, and a rotating plate 15*c* for connecting the rotor 15*b* to the rotary shaft 13.

An opening 16 is formed through the front surface of the main body 10 at a position corresponding to an opening 12*a* of the rotary drum 12 and an opening 11*a* of the tub 11 so that a user can insert or take laundry into or out of the rotary drum 12, and a door 17 for opening and closing the opening 16 is installed around the opening 16.

A detergent supply device 18 for supplying a detergent to the inside of the tub 11 and a steam generator 30 for supplying steam to the inside of the tub 11 are installed above the tub 11. A drain device 19 comprising a drain pipe 19*a*, a drain valve 19*b* and a drain motor 19*c* for discharging water from the inside of the tub 11 to the outside of the washing machine is installed below the tub 11.

A first electric heater 20 (hereinafter, referred to as "a first heater") for heating the washing water is installed on the bottom of the tub 11.

Although now shown in FIG. 1, the washing machine of the present invention further comprises a water level sensor 42 installed in the tub 11 for sensing the level of the washing water, and a first temperature sensor 44 for measuring the temperature of the washing water.

The detergent supply device 18 has a space formed therein for containing the detergent, and is installed in the front surface of the main body 10 so that a user can easily insert the detergent into the detergent supply device 18. A first water supply pipe 21 branching off from a pipe connected to an external water supply source is connected to the detergent supply device 18, and a first water supply valve 22 for controlling the supply of the water to the detergent supply device 18 is installed in the first water supply pipe 21. A connection pipe 23 for supplying the water from the detergent supply device 18 to the tub 11 is connected between the detergent supply device 18 and the tub 11. The connection pipe 23 supplies the water from the outside to the tub 11 through the detergent supply device 18, thereby supplying the detergent contained in the detergent supply device 18 to the tub 11 under the condition that the detergent dissolves in the water.

A second water supply pipe 24 branching off from the pipe connected to the external water supply source (not shown) is connected to the steam generator 30, and a second water supply valve 25 for controlling the supply of the water to the steam generator 30 is installed in the second water supply pipe 24. Further, a steam supply pipe 26 for guiding steam generated from the steam generator 30 to the inside of the tub 11 is connected to the steam generator 30.

Figure 2:
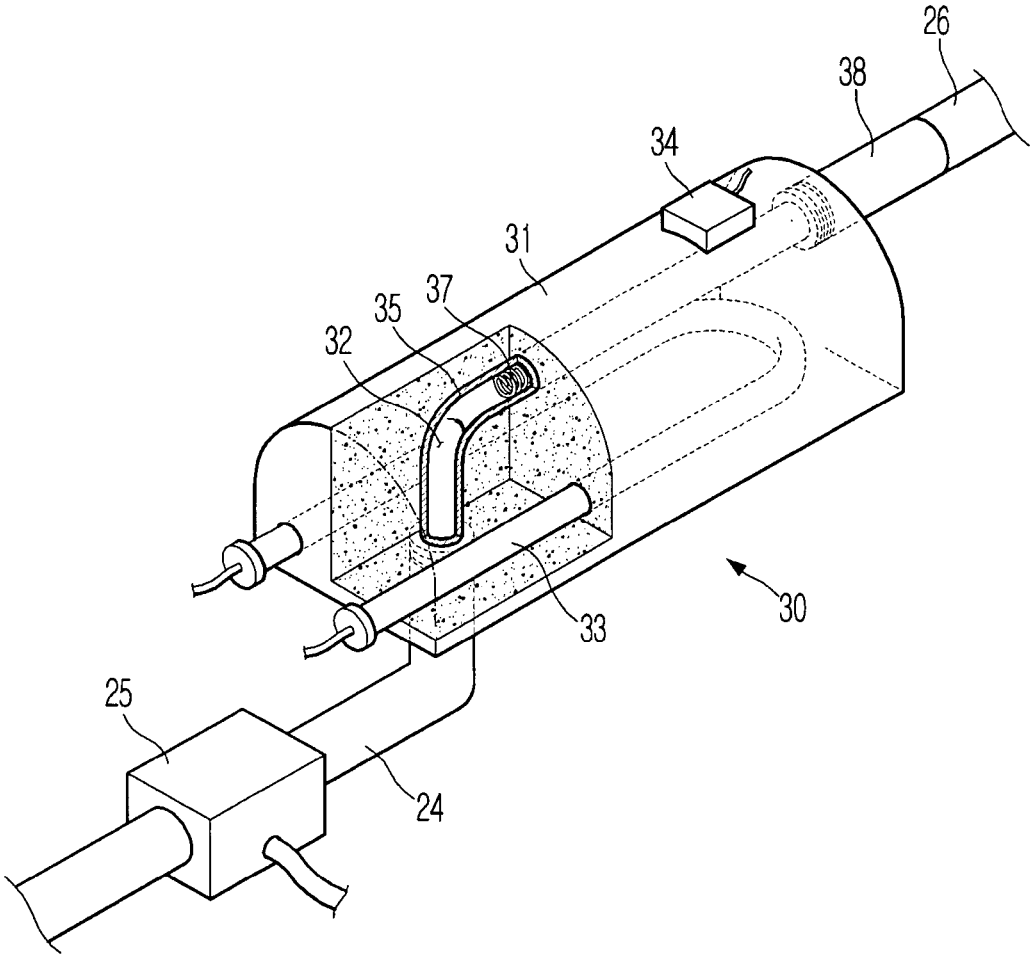
FIG. 2 is a perspective view of a steam generator of the washing machine in accordance with an aspect of the present invention.
Figure 3:
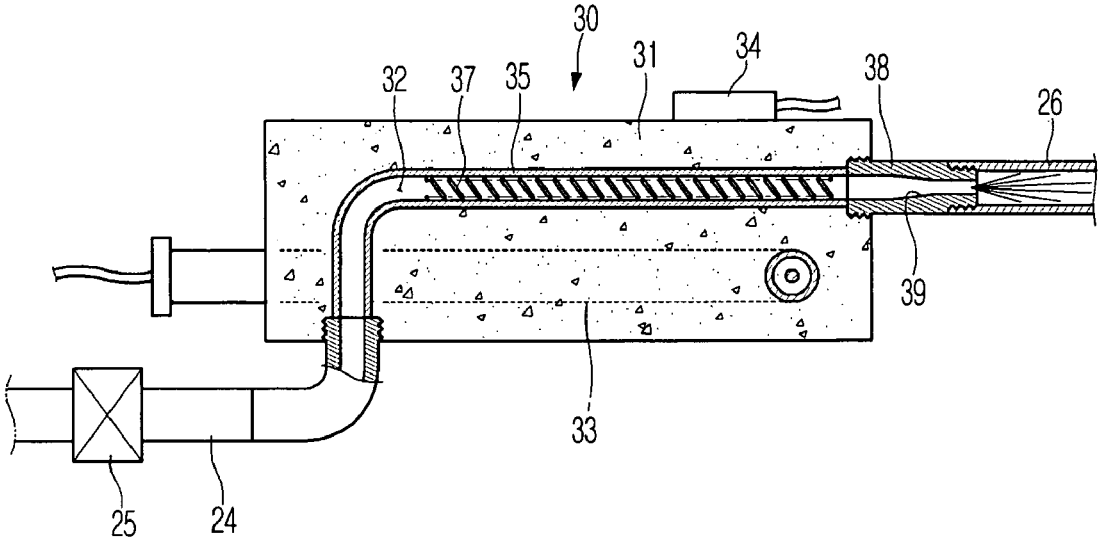
FIG. 3 is a sectional view of the steam generator of the washing machine in accordance with an aspect of the present invention.

As shown in FIGS. 2 and 3, the steam generator 30 comprises a body 31 made of a mold obtained by die-casting aluminum, a steam generating channel 32 formed in the body 31 and provided with an inlet connected to second water supply pipe 24 and an outlet connected to the steam supply pipe 26, a second electric heater (hereinafter, referred to as "a second heater") buried in the body 31 for heating the water passing through the steam generating channel 32 to generate steam, and a second temperature sensor 34 installed on the outer surface of the body 31 for sensing the temperature of the body 31 to control the heater 33.

As shown in FIGS. 2 and 3, the body 31 of the steam generator 30 is molded by die-casting aluminum, and a pipe 35 for forming the steam generating channel 32 and the heater 33 are buried in the steam generator 30 during the molding of the body 31. Since the body 31 of the steam generator 30 is made of a metal having high thermal conductivity and the heater 33 is buried in the body 31, the body 31 is heated to a high temperature by the heater 33. Further, water flowing along the steam generating channel 32 is heated by the heat of the body 31, thus being changed to steam. That is, a small amount of water is supplied to the steam generating channel 32 under the condition that the body 31 is heated to a high temperature. Thus, while the water passes through the steam generating channel 32, the water is heated and changed to steam of a high temperature in a short period of time. In order to smoothly perform the above procedure, as shown in FIG. 2, the body 31 has a rod shape having a designated length and the steam generating channel 32 is formed in the longitudinal direction of the body 31. In this embodiment, as shown in FIG. 2, the U-shaped heater 33 is buried in the body 31.

As shown in FIG. 3, the outlet of the steam generating channel 32 connected to the steam supply pipe 26 is always opened, and the inner diameter of the outlet of the steam generating channel 32 is smaller than the inner diameter of the inlet of the steam generating channel 32. The relatively smaller inner diameter of the outlet of the steam generating channel 32 generates channel resistance at the outlet, and increases a stay time of the steam in the steam generating channel 32, thereby effectively generating the steam of a high temperature. Further, the opened structure of the outlet of the steam generating channel 32 prevents the excessive increase of a pressure in the steam generating channel 32, thereby assuring the safety of the steam generator 30. A spiral coil member 37 for delaying the flow of the water in the steam generating channel 32 so that the generation of the steam is facilitated is installed in the steam generating channel 32, as shown in FIG. 3.

When water is supplied to the steam generator 30, the water supply and the suspension of the water supply are repeated through the second water supply valve 25 or a small amount of the water flows along the steam generating channel 32 by opening the steam generating channel 32 to a small degree so that the all amount of the water supplied to the steam generator 30 can be heated through the steam generating channel 32 and be evaporated to steam. For this reason, it is preferable that a motor operated valve opened and closed by electric motion or a flow control valve controlling a flow rate is used as the second water supply valve 25.

Figure 4:
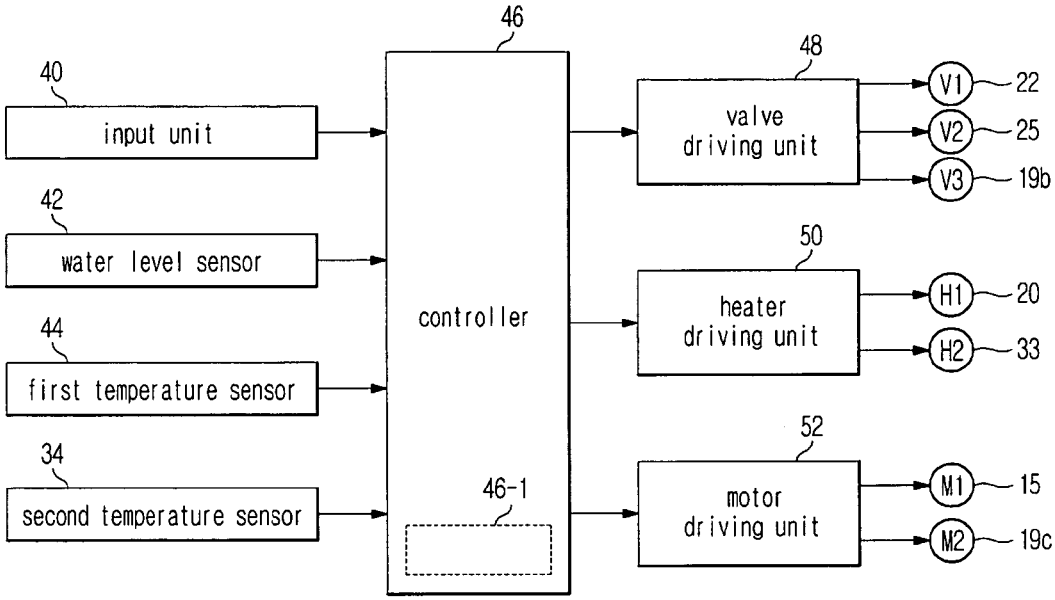
FIG. 4 is a block diagram of the washing machine in accordance with an aspect of the present invention.

The washing machine of the present invention further comprises a controller 46 for controlling the overall washing operations of the washing machine including the operation of the steam generator 30. Hereinafter, the controller will be described with reference to FIG. 4.

An input unit 60 for inputting user's instructions to the controller 46, the water level sensor 42 for sensing the level of the washing water, the first temperature sensor 44 for sensing the temperature of the washing water, and the second temperature sensor 34 for sensing the temperature of the body 31 of the steam generator 30 are electrically connected to an input side of the controller 46.

A valve driving unit 48 for controlling the operations of the first water supply valve 22, the second water supply valve 25 and the drain valve 19*b*, a heater driving unit 50 for controlling the operations of the first heater 20 and the second heater 33, and a motor driving unit 52 for controlling the operations of the washing motor 15 and the drain motor 19*c* are electrically connected to an output side of the controller 46.

The controller 46 comprises a counter 46-1 for measuring the operating time of the second heater 33.

Figure 5:
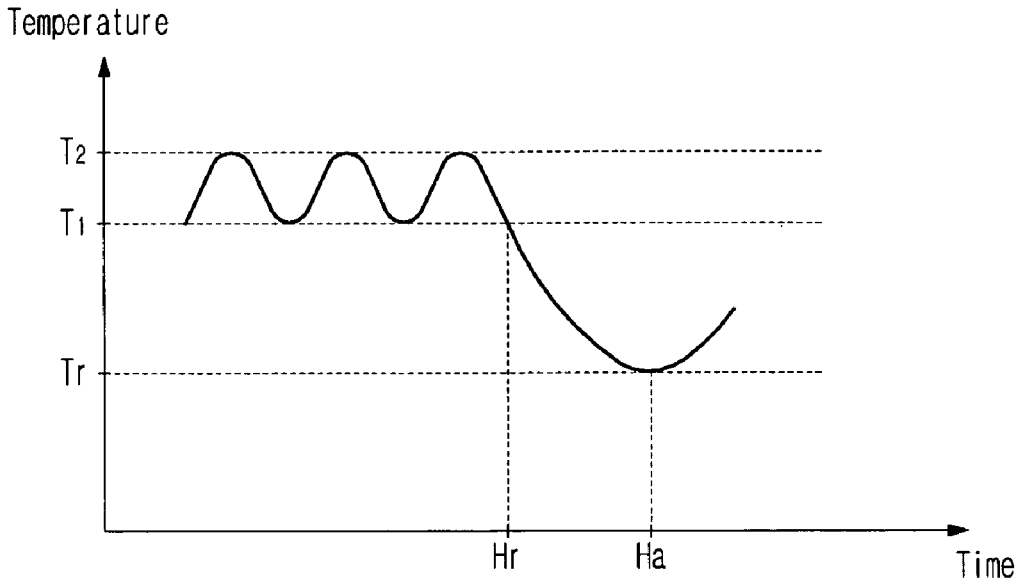
FIG. 5 is a graph illustrating the control of the operation of a heater of the steam generator of the washing machine in accordance with an aspect of the present invention.

The controller 46 controls the operations of the second heater 33 of the steam generator 30 and the second water supply valve 25. The controller 46 controls the supply of water to the steam generator 30 by adjusting the opening and closing or the opening degree of the second water supply valve 25 using a program, which was set in advance, or based on data sensed by the second temperature sensor 34 installed in the body 31 of the steam generator 30. In the case that the controller 46 controls the supply of water based on the data sensed by the second temperature sensor 34, when the temperature of the body 31 is excessively lowered, the controller 46 decreases the supply amount of the water or stops the supply of the water, and when the temperature of the body 31 is excessively elevated, the controller 46 increases the supply amount of the water. As shown in FIG. 5, when the temperature of the body 31 sensed by the second temperature sensor 34 is elevated to a temperature T2 (for example, 180° C.), the second heater 33 is turned off, and when the temperature of the body 31 sensed by the second temperature sensor 34 is lowered to a temperature T1 (for example, 160° C.), the second heater 33 is turned on.

The pipe 35 for forming the steam generating channel 32 is made of stainless steel having low surface roughness so as to prevent the accumulation of scale in the steam generating channel due to the long-term use of the steam generator, and the inner surface of the pipe 35 is smoothened by electrolytic polishing. The smooth inner surface of the pipe 35 minimizes the attachment of impurities thereonto, thereby preventing the accumulation of scale in the steam generating channel 32.

An outlet nozzle 38 having a tapered inner surface 39 so that the inner diameter of the outlet nozzle 38 is decreased from one end thereof close to an outlet of the steam generating channel 32 to the other end distant from the outlet, is installed at the outlet of the steam generating channel 32. This structure of the outlet nozzle 38 generates channel resistance at the outlet, and prevents the accumulation of scale in the steam generating channel 32. That is, the outlet nozzle 38 has the tapered inner surface 39 so that the inner diameter of the end of the outlet nozzle 38 close to the outlet is the same as the inner diameter of the pipe 35 and the inner diameter of the outlet nozzle 38 is gradually decreased from the end thereof close to the outlet to the end thereof distant from the outlet. The above structure of the outlet nozzle 39 allows impurities in the steam generating channel 32 to be smoothly discharged to the outlet, thereby preventing the accumulation of scale in the steam generating channel 32.

Although the steam generator 30 has such a structure for preventing the accumulation of scale in the steam generating channel 32, when the steam generator 30 is used for a long period of time, a small amount of scale may be accumulated in the steam generating channel 32. Accordingly, for example, when the operation for increasing the temperature of the washing water using steam is performed for a long period of time, an operation for cooling the steam generator 30 is required so as to prevent the accumulation of a small amount of scale.

That is, as shown in FIG. 5, the controller 46 controls the operations of the second heater 33 and the second water supply valve 25 so that the steam generator 30 is cooled so as to prevent the accumulation of scale in the steam generator 30 when the operating time of the steam generator 30 reaches a reference time Hr, and then controls the operations of the second heater 33 and the second water supply valve 25 so that the steam generator 30 generates steam when the temperature of the body 31 is lowered to a reference temperature Tr after a designated time Ha has elapsed.

Figure 6:
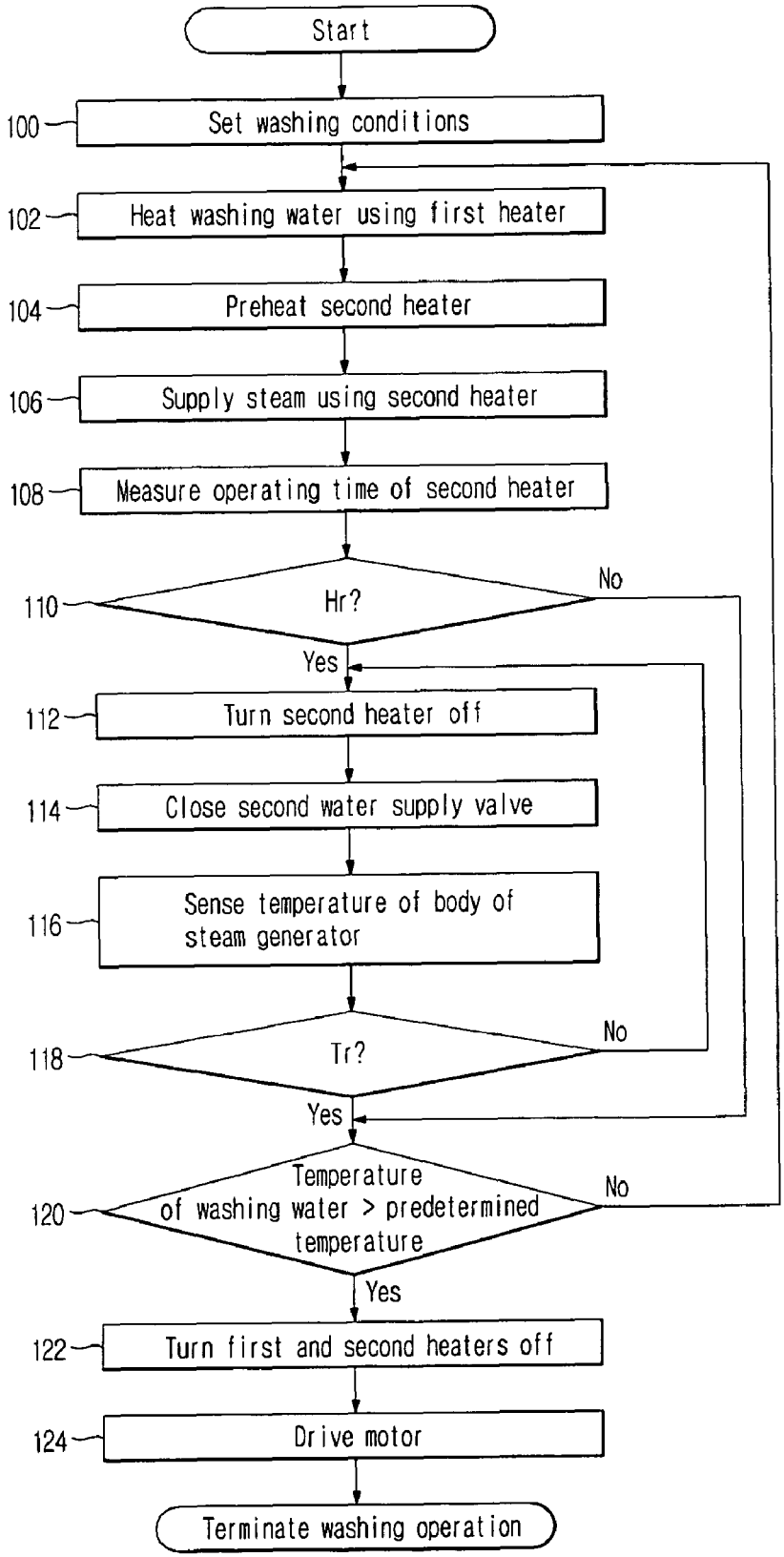
FIG. 6 is a flow chart illustrating a method for controlling a washing machine in accordance with one embodiment of the present invention.

In accordance with the first embodiment of the present invention, only the second heater 33 is turned off under the condition that the supply of the water through the second water supply valve 25 is stopped, as shown in FIG. 6, thereby performing a cooling operation of the steam generator 30. Hereinafter, the cooling operation of the steam generator 30 will be described with reference to FIGS. 1 and 6.

In operation 100, a user sets washing conditions, such as a washing course, a washing temperature, the number of a rinsing operation, and a dehydrating speed, through the input unit 40 under the condition that laundry is placed into the rotary drum 12, the controller 46 starts the washing of the laundry according to the washing conditions.

At this time, the controller 46 opens the first water supply valve 22 so that water is supplied to the detergent supply device 18, and the detergent contained in the detergent supply device 18 is dissolved in the supplied water and is supplied to the tub 11. This water supply operation is continued until a designated amount of washing water is supplied to the inside of the tub 11.

Then from operation 100, the process moves to operation 102 where the controller 46 turns the first heater 20 on so that the washing water contained in the tub 11 is heated by the first heater 20.

During heating the washing water, when a washing function using steam of a high temperature is required, in operation 104, the controller 46 preheats the second heater 33 for a designated time. Such a preheating operation is performed under the condition that the second water supply valve 25 is closed. The preheating operation serves to generate steam immediately when the water is supplied to the steam generator 30. The preheating operation is performed only when the preheating of the second heater 33 is required based on the temperature of the body 31.

After the second heater 33 is preheated in operation 104, the process moves to operation 106, where the steam is supplied to the inside of the tub 11 in order to elevate the temperature of the washing water heated by the first heater 20. Here, the controller 46 opens the second water supply valve 25 so as to supply water and turns the second heater 33 on simultaneously. Then, the controller 46 controls the operation of the second heater 33 so that the temperature of the body 31 sensed by the second temperature sensor 34 is changed in a predetermined temperature range (between temperatures T1 and T2).

From operation 106, the process moves to operation 108 where the counter 46-1 measures the operating time of the second heater 33 cumulatively.

From operation 108, the process moves to operation 110 where the controller 46 determines whether the measured operating time of the second heater 33 reaches the reference time Hr. When it is determined that the measured operating time of the second heater 33 does not reach the reference time Hr in operation 110, the process moves to operation 120. On the other hand, when it is determined that the measured operating time of the second heater 33 reaches the reference time Hr in operation 110, the process moves to operation 112, where the controller 46 turns the second heater 33 off so as to cool the steam generator 30. From operation 112, the process moves to operation 114, where the second water supply valve 25 is turned off so that the supply of the water is stopped.

From operation 114, the process moves to operation 116, where the controller 46 senses the temperature of the body 31 through the second temperature sensor 34 during cooling of the steam generator, and from operation 116, the process moves to operation 118 where the controller determines whether the sensed temperature of the body 31 is lowered less than the reference temperature Tr. When it is determined that the sensed temperature of the body 31 is not less than the reference temperature Tr in operation 118, the process returns back to operation 112 to continue the cooling of the steam generator 30.

When it is determined that the sensed temperature of the body 31 is less than the reference temperature Tr in operation 118, the process moves to operation 120, where the controller 46 determines whether the temperature of the washing water sensed by the first temperature sensor 44 exceeds a predetermined temperature set by a user. When it is determined that the sensed temperature of the washing water does not exceed the predetermined temperature in operation 120, the process returns back to operation 102 to elevate the temperature of the washing water.

When it is determined that the sensed temperature of the washing water exceeds the predetermined temperature in operation 120, the process moves to operation 122, where the controller 46 turns the first and second heaters 20 and 33 off, thus stopping the elevating of the temperature of the washing water. From operation 122, the process moves to operation 124, where the controller 46 drives the washing motor 15 to rotate the rotary drum 12 at a low speed, thus performing a washing operation of the laundry.

After the washing operation has been terminated, a rinsing operation, which is carried out by supplying water to the tub 11 and discharging the water from the tub 11, and a dehydrating operation are performed. The drain of the tub 11 is performed by opening the drain valve 19*b* and operating the drain pump 19*c*. The dehydrating operation is performed by operating the drain pump 19*c* under the condition that the drain valve 19*b* is opened and rotating the rotary drum 12 at a high speed for a designated time.

The first embodiment of the present invention applies a method, in which the second heater 33 is turned off so as to naturally cool the steam generator 30 when the operating time of the second heater 33 reaches the reference time during generating steam and supplying the steam to the tub 11. Thereby, it is possible to prevent the accumulation of a small amount of scale in the steam generating channel 32.

When the reference temperature Tr to be compared to the temperature of the body 31 in the first embodiment is set to a low value, a cooling effect is increased but a cooling time is increased. Accordingly, it is preferable that the reference temperature Tr is set in consideration of the above relation.

Further, in accordance with a second embodiment of the present invention, in addition to turning the second heater 33 off, the second water supply valve 25 is opened so as to supply cold water to the steam generating channel 32. Here, the supplied cold water is not heated and is introduced into the tub 11 through the steam supply pipe 26. Preferably, the level of the washing water in the tub 11 is considered when the cold water for cooling the steam generator 30 is supplied to the steam generator 30. Accordingly, before the cold water is supplied to the steam generating channel 32, the level of the washing water in the tub 11 is compared to a predetermined water level, and whether or not the cold water is supplied to the steam generating channel 32 is determined based on the obtained comparison result.

Figure 7:
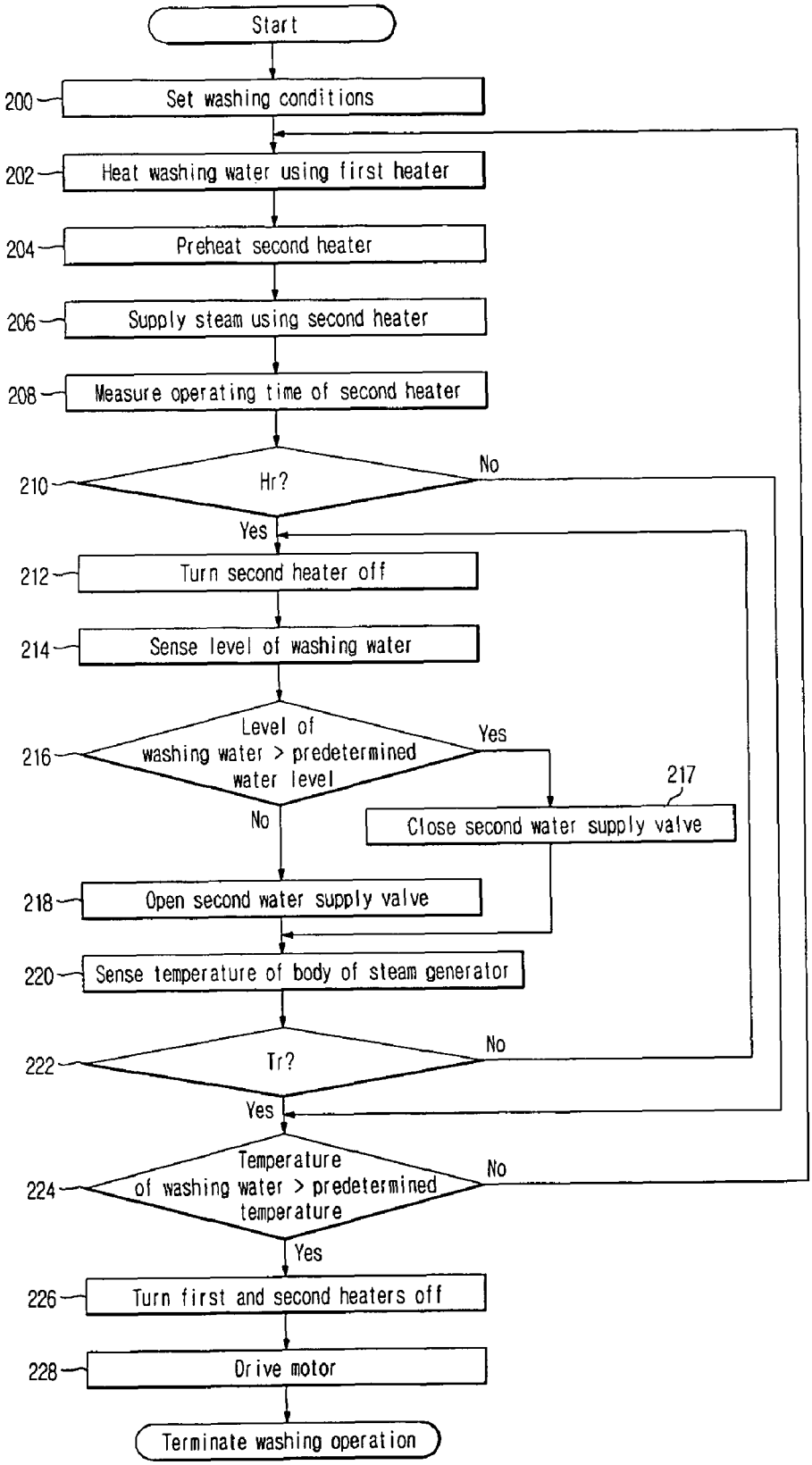
FIG. 7 is a flow chart illustrating a method for controlling a washing machine in accordance with another embodiment of the present invention.

As shown FIG. 7, in operation 200, when a user sets washing conditions through the input unit 40 under the condition that laundry is placed into the rotary drum 12, the controller 46 starts the washing of the laundry according to the washing conditions.

At this time, the controller 46 opens the first water supply valve 22 so that water is supplied to the detergent supply device 18, and the detergent contained in the detergent supply device 18 is dissolved in the supplied water and is supplied to the tub 11. This water supply operation is continued until a designated amount of washing water is supplied to the inside of the tub 11. Then from operation 200, the process moves to operation 202, where the controller 46 turns the first heater 20 on so that the washing water contained in the tub 11 is heated by the first heater 20.

During heating the washing water in operation 202, when a washing function using steam of a high temperature is required, the process moves to operation 204, where the controller 46 preheats the second heater 33 for a designated time. Such a preheating operation is performed under the condition that the second water supply valve 25 is closed. The preheating operation serves to generate steam immediately when the water is supplied to the steam generator 30. The preheating operation is performed only when the preheating of the second heater 33 is required based on the temperature of the body 31.

After the second heater 33 is preheated, the steam is supplied to the inside of the tub 11 in order to elevate the temperature of the washing water heated by the first heater 20. Here, the controller 46 opens the second water supply valve 25 so as to supply water and turns the second heater 33 on simultaneously. Then, from operation 204, the process moves to operation 206, where the controller 46 controls the operation of the second heater 33 so that the temperature of the body 31 sensed by the second temperature sensor 34 is changed in a predetermined temperature range (between temperatures T1 and T2).

From operation 206, the process moves to operation 208, where the counter 46-1 measures the operating time of the second heater 33 cumulatively.

From operation 208, the process moves to operation 210, where the controller 46 determines whether the measured operating time of the second heater 33 reaches the reference time Hr. When it is determined that the measured operating time of the second heater 33 does not reach the reference time Hr in operation 210, the process moves to operation 224. On the other hand, when it is determined that the measured operating time of the second heater 33 reaches the reference time Hr in operation 210, the process moves to operation 212 where the controller 46 turns the second heater 33 off so as to cool the steam generator 30. Then from operation 212, the process moves to operation 216, where the controller 46 determines whether the level of the washing water sensed by the water level sensor 42 exceeds the predetermined water level, and from operation 216, the process moves to operation 217, where the controller turns the second water supply valve 25 off when it is determined in operation 216, that the sensed washing water level exceeds the predetermined water level.

On the other hand, when it is determined that the sensed washing water level does not exceed the predetermined water level in operation 216, the process moves to operation 218, where the second water supply valve 25 is opened so as to rapidly cool the steam generator 30, thereby supplying cold water to the steam generator 30 through the steam generating channel 32.

From operation 218, the process moves to operation 220, where the controller 46 senses the temperature of the body 31 through the second temperature sensor 34 during cooling of the steam generator, and from operation 220, the process moves to operation 222, where the controller determines whether the sensed temperature of the body 31 is less than the reference temperature Tr. When it is determined that the sensed temperature of the body 31 is not less than the reference temperature Tr in operation 222, the process returns back to operation 212 to continue the cooling of the steam generator 30.

When it is determined that the sensed temperature of the body 31 is less than the reference temperature Tr in operation 222, the process moves to operation 224, where the controller 46 determines whether the temperature of the washing water sensed by the first temperature sensor 44 exceeds a predetermined temperature set by a user. When it is determined that the sensed temperature of the washing water does not exceed the predetermined temperature in operation 224, the process returns back to operation 202 to elevate the temperature of the washing water.

When it is determined that the sensed temperature of the washing water exceeds the predetermined temperature in operation 224, the process moves to operation 226, where the controller 46 turns the first and second heaters 20 and 33 off, thus stopping the elevating of the temperature of the washing water. From operation 226, the process moves to operation 228, where the controller 46 drives the washing motor 15 to rotate the rotary drum 12 at a low speed, thus performing a washing operation of the laundry.

After the washing operation has been terminated, a rinsing operation, which is carried out by supplying water to the tub 11 and discharging the water from the tub 11, and a dehydrating operation are performed.

In the second embodiment, the second heater 33 is turned off and the second water supply valve 25 is opened simultaneously so as to supply cold water, when the operating time of the second heater 33 reaches the reference time during generating steam and supplying the generated steam to the tub 11, thus cooling the steam generator 30 in a short time. Thereby, it is possible to prevent the accumulation of a small amount of scale in the steam generating channel 32.

The reference temperature Tr to be compared to the temperature of the body 31 in the second embodiment is set to a value sufficient to cool the steam generator 30. Accordingly, it is preferable that the reference temperature Tr is set to be equal to the predetermined temperature in order to prevent the lowering of the temperature of the washing water in consideration of the supply of the cold water to the tub 11 through the steam generating channel 32.

As apparent from the above description, the present invention provides a washing machine having a steam generator for generating steam of a high temperature, in which an operation for cooling the steam generator is performed so as to prevent the accumulation of scale in the steam generator due to the long-term use thereof, and a method for controlling the same.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method for controlling a washing machine having a steam generator including a water supply valve for supplying water to the inside of the steam generator therethrough, and a heater for heating the water supplied through the water supply valve, the method comprising:

measuring an operating time of the steam generator;

determining whether the measured operating time of the steam generator exceeds a predetermined time; and controlling the water supply valve and the heater, to thereby cool the steam generator, when it is determined that the measured operating time of the steam generator exceeds the predetermined time, wherein the control of the water supply valve and the heater comprises:

sensing a temperature of the steam generator, using a temperature sensor, the temperature sensor being installed on a body of the steam generator;

comparing the temperature of the steam generator sensed by the temperature sensor to a reference temperature; and controlling the cooling operation of the steam generator according to the comparison result to prevent the accumulation of scale in the steam generator.

2. The method as set forth in claim 1, wherein the operating time of the steam generator is a cumulative operating time of the heater.

3. The method as set forth in claim 1, wherein a cooling operation of the steam generator is performed by turning the heater off.

4. The method as set forth in claim 1, wherein a cooling operation of the steam generator is performed by simultaneously turning the heater off and opening the water supply valve to supply the water.

5. The method as set forth in claim 1, wherein the cooling operation of the steam generator is repeated until the temperature of the steam generator sensed by the temperature sensor is less than the reference temperature.

6. The method according to claim 1, wherein the reference temperature is more than a predetermined temperature set by a user for performing a washing operation.

7. The method according to claim 1, wherein the steam generator is re-operated to generate steam, if it is determined that a supply of steam is required after the steam generator is cooled to the reference temperature.

* * * * *